US007665320B2

(12) United States Patent
Scrivener et al.

(10) Patent No.: US 7,665,320 B2
(45) Date of Patent: Feb. 23, 2010

(54) DAMPER ASSEMBLY AND METHODS FOR A REFRIGERATION DEVICE

(75) Inventors: Art W. Scrivener, Louisville, KY (US); Kristen Kamath, Palatine, IL (US); Richard DeVos, Goshen, KY (US); William Newton, Brooks, KY (US)

(73) Assignee: General Electric Company, Schenectady, NY (US)

( * ) Notice: Subject to any disclaimer, the term of this patent is extended or adjusted under 35 U.S.C. 154(b) by 735 days.

(21) Appl. No.: 11/289,913

(22) Filed: Nov. 30, 2005

(65) Prior Publication Data

US 2007/0119198 A1 May 31, 2007

(51) Int. Cl.
*F25D 17/04* (2006.01)
*F24F 7/00* (2006.01)

(52) U.S. Cl. ..... 62/187; 236/49.5; 454/239; 454/256

(58) Field of Classification Search ..... 62/186, 62/187; 236/49.3, 49.5; 454/239, 256, 265
See application file for complete search history.

(56) References Cited

U.S. PATENT DOCUMENTS 4,383,641 A * 5/1983 Shreve ..... 236/49.3
5,048,306 A 9/1991 Wakatsuki et al.
5,172,566 A 12/1992 Jung et al.
6,286,326 B1 9/2001 Kopko
6,539,729 B2 4/2003 Tupis et al.
2005/0126207 A1 6/2005 Lee et al.
2005/0189184 A1 9/2005 Osvatic et al.
2006/0032264 A1 2/2006 Shim

* cited by examiner

*Primary Examiner*—Marc E Norman
(74) *Attorney, Agent, or Firm*—George L. Ridgeout, Esq.; Armstrong Teasdale LLP

(57) ABSTRACT

A refrigerator includes a housing defining a fresh food compartment and a freezer compartment, a fan configured to provide airflow through the compartments, and a damper assembly. The damper assembly includes an airflow passage configured to allow cold air to flow from the freezer compartment to the fresh food compartment, a damper configured to be in an open position under the pressure of airflow flowing through the airflow passage and in a closed position due to a weight of the damper when cold air is flowing through the fresh food compartment. The damper assembly also includes a solenoid element configured to maintain the damper in the closed position regardless of airflow.

26 Claims, 4 Drawing Sheets

DAMPER ASSEMBLY AND METHODS FOR A REFRIGERATION DEVICE

BACKGROUND OF THE INVENTION

This invention relates generally to refrigeration devices, and more particularly, to a damper apparatus and methods for assembling a refrigeration device to control temperature therein.

Conventional temperature control devices used in refrigeration devices currently commercially available typically are provided with a damper thermostat for controlling the flow of cooled air. The damper thermostat is provided in a duct through which the cooled air from the refrigerator is guided into the refrigerating chamber. The damper thermostat determines the expansion or compression of bellows that occur due to the change in volume of a gas sealed in a thermosensitive tube, which depends on the temperature of the air in the refrigerating chamber. The sensed change in the bellows is transferred, by means of, for example, an operating rod, to the blade of a damper which opens or closes the duct to control the flow of cooled air therethrough.

In such a damper having a gas-actuated thermostat as described above, a heater for preventing an erroneous operation is usually provided for the parts of the thermostat assembly other than the thermosensitive element to keep the thermostat element warmer than the other parts of the thermostat assembly. Consequently, even though the capacity of the heater is as small as about 1-2 W, the accumulated consumption of electric power over a month or a year may be considerable. Moreover, the customary provision of the thermostat assembly close to or in the refrigerating chamber causes the heater to be a heat generating means associated with the refrigerating chamber.

BRIEF DESCRIPTION OF THE INVENTION

In one aspect, a damper apparatus is provided. The damper apparatus includes a housing configured to allow cold air to flow therethrough and a damper configured to be in an open position under the pressure of cold air flowing through the housing and in a closed position due to a weight of the damper when no air is flowing through the housing. The apparatus also includes a solenoid element configured to maintain the damper in the closed position regardless of airflow.

In another aspect, a refrigerator is provided. The refrigerator includes a housing defining a fresh food compartment and a freezer compartment, a fan configured to provide airflow through the compartments, and a damper assembly. The damper assembly includes an airflow passage configured to allow cold air to flow from the freezer compartment to the fresh food compartment and a damper configured to be in an open position under the pressure of air flowing through the airflow passage and in a closed position due to a weight of the damper when cold air is flowing through the fresh food compartment. The apparatus also includes a solenoid element configured to maintain the damper in the closed position regardless of airflow.

In still another aspect, a method of assembling a refrigerator is provided. The method includes providing a housing with a fresh food compartment and a freezer compartment, providing an airflow passage configured to allow air to flow between the freezer compartment and the fresh food compartment, and coupling a damper to the airflow passage. The damper is configured to be in an open position under the pressure of cold airflow which flows through the airflow passage and in a closed position due to a weight of the damper when air is not flowing in the housing. The method further includes operatively coupling a solenoid to the damper. The solenoid is configured to maintain the damper in the closed position when the solenoid is actuated.

In still another aspect, a cooling circuit is provided for a refrigeration device having at least a first compartment and a second compartment. The cooling circuit includes a cooling unit configured to cool the compartments, and a damper assembly is positioned within the first compartment to provide airflow communication with the compartments. The damper assembly includes a damper configured to be in an open position under the pressure of the air flowing from the second compartment to the first compartment and in a closed position due to a weight of itself when no air is flowing through the first compartment. The damper assembly also includes a solenoid apparatus configured to maintain the damper in the closed position when the solenoid is actuated.

DETAILED DESCRIPTION OF THE INVENTION

Figure 1:
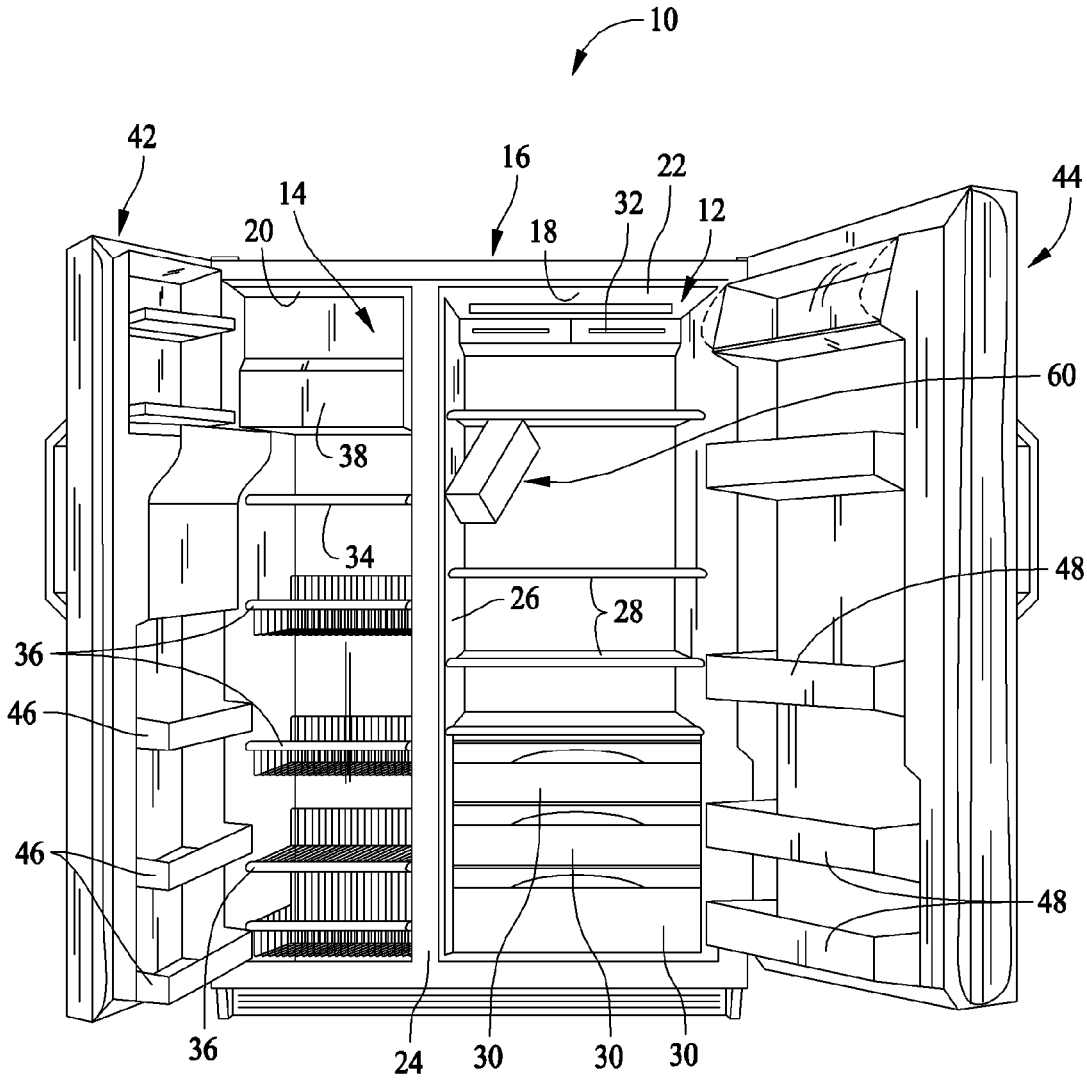
FIG. 1 illustrates an exemplary refrigerator in accordance with one embodiment of the present invention.

FIG. 1 illustrates an exemplary refrigeration appliance 10 in which the present invention may be practiced. In the embodiment described and illustrated herein, appliance 10 is a side-by-side refrigerator. It is recognized, however, that the benefits of the present invention are equally applicable to other types of refrigerators, freezers, and refrigeration appliances. Consequently, the description set forth herein is for illustrative purposes only and is not intended to limit the invention in any aspect.

Refrigerator 10 includes a fresh food storage compartment 12 and a freezer storage compartment 14. Fresh food compartment 12 and freezer compartment 14 are arranged side-by-side within an outer case 16 and defined by inner liners 18 and 20 therein. A space between case 16 and liners 18 and 20, and between liners 18 and 20, is filled with foamed-in-place insulation. Outer case 16 normally is formed by folding a sheet of a suitable material, such as pre-painted steel, into an inverted U-shape to form top and side walls of case 16. A bottom wall of case 16 normally is formed separately and attached to the case side walls and to a bottom frame that provides support for refrigerator 10. Inner liners 18 and 20 are molded from a suitable plastic material to form fresh food compartment 12 and freezer compartment 14, respectively. Alternatively, liners 18, 20 may be formed by bending and welding a sheet of a suitable metal, such as steel. The illustrative embodiment includes two separate liners 18, 20 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 22 extends between a case front flange and outer front edges of liners 18, 20. Breaker strip 22 is formed from a suitable resilient material, such as an extruded acrylo-butadiene-styrene based material (commonly referred to as ABS).

The insulation in the space between liners 18, 20 is covered by another strip of suitable resilient material, which also commonly is referred to as a mullion 24. In one embodiment, mullion 24 is formed of an extruded ABS material. Breaker strip 22 and mullion 24 form a front face, and extend completely around inner peripheral edges of case 16 and vertically between liners 18, 20. Mullion 24, insulation between compartments, and a spaced wall of liners separating compartments, sometimes are collectively referred to herein as a center mullion wall 26.

In addition, refrigerator 10 includes shelves 28 and slide-out storage drawers 30, sometimes referred to as storage pans, which normally are provided in fresh food compartment 12 to support items being stored therein.

Refrigerator 10 is controlled by a microprocessor (not shown) according to user preference via manipulation of a control interface 32 mounted in an upper region of fresh food storage compartment 12 and coupled to the microprocessor. A shelf 34 and wire baskets 36 are also provided in freezer compartment 14. In addition, an ice maker 38 may be provided in freezer compartment 14.

A freezer door 42 and a fresh food door 44 close access openings to fresh food and freezer compartments 12, 14, respectively. Each door 42, 44 is mounted to rotate about its outer vertical edge between an open position, as shown in FIG. 1, and a closed position (not shown) closing the associated storage compartment. Freezer door 42 includes a plurality of storage shelves 46, and fresh food door 44 includes a plurality of storage shelves 48.

Refrigerator 10 includes a damper assembly 60. In one exemplary embodiment, damper assembly 60 is positioned in fresh food compartment 12. More particularly, damper assembly 60 is arranged on an inner surface of fresh food compartment 12, i.e. on one side (not labeled) of central mullion wall 26. In the other exemplary embodiment, damper assembly 60 can also be positioned on the other inner walls, such as, the rear wall (not labeled) of fresh food compartment 12.

Figure 2:
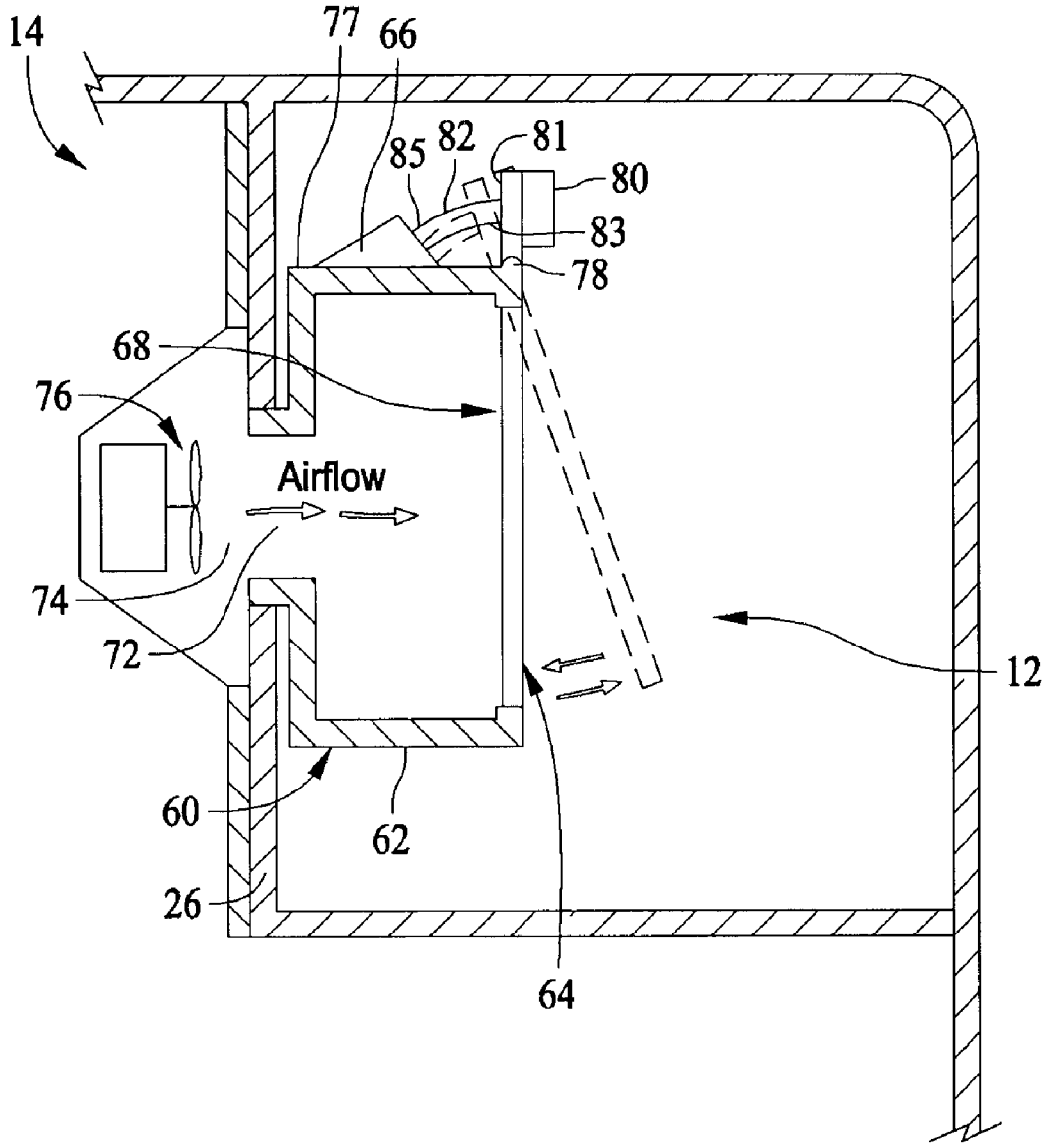
FIG. 2 is a partial schematic view of fresh food compartment of refrigerator shown in FIG. 1 including a damper assembly.

FIG. 2 is a partial schematic view of fresh food compartment 12 of refrigerator 10 (shown in FIG. 1) including damper assembly 60. Damper assembly 60 includes a housing 62, a damper 64, and a solenoid element 66. Housing 62 is made from some insulative materials, such as polystyrene foam. Housing 62 defines a first opening 68 through the front (not labeled) and a second opening or through hole 72 through the rear. Both of first opening 68 and second opening 72 are utilized to allow airflow to pass therethrough. Second opening 72 is in flow communication with a duct 74 defined through central mullion wall 26. An evaporator fan 76 is arranged in proximity to an entrance of duct 74, providing airflow from freezer compartment 14 through duct 74 and housing 62, then to fresh food compartment 12. In one exemplary embodiment, a cap 77 is mounted on the top of housing 62 to cover housing 62. In another embodiment, cap 77 can be integrally formed with housing 62. In the exemplary embodiment, cap 77 is made from insulative materials, such as polystyrene foam.

Damper 64 is mounted to housing 62 with a hinge 78 along the front and top edge (not labeled) of housing 62 and is sized to cover first opening 68. Damper 64 is rotatable around hinge 78 to an open position to allow airflow therethrough and a closed position to seal housing 62. In the exemplary embodiment, a counterweight 80 is mounted on a first end 81 of damper 64 to facilitate eliminating swing of damper 64. Solenoid element 66 is positioned on a top of housing 62, and is operatively coupled to damper 64 through a plunger 82. More specifically, plunger 82 is engaged with damper first end 81 at a first end 83 and is engaged with solenoid element 66 at other end 85. In the exemplary embodiment, solenoid element 66 is a direct-current solenoid with a stepper motor (shown in FIG. 3). Upon actuation, solenoid element 66 drives damper first end 81 away by means of plunger 82 or other known components, thereby maintaining damper 64 in the closed position regardless of airflow. In addition, damper is biased to remain in the closed position due to the weight of the damper and the force of gravity working on the damper.

Figure 3:
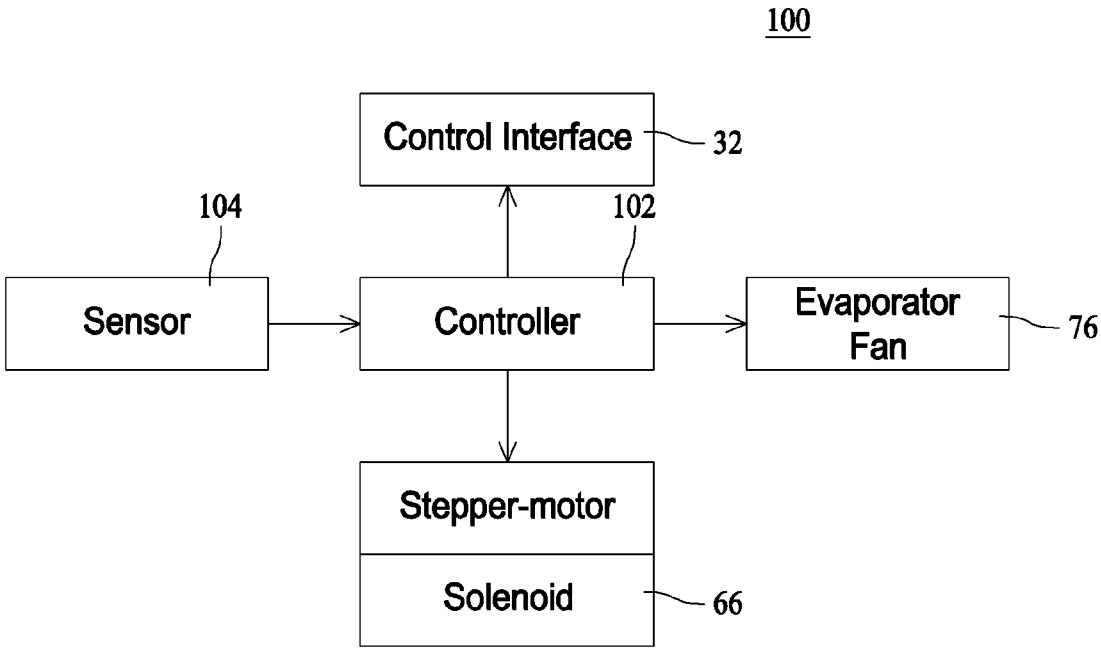
FIG. 3 is a schematic view of a control system applicable to the refrigerator shown in FIG. 1.

FIG. 3 is a schematic view of a control system 100 applicable to refrigerator 10 shown in FIG. 1. Control system 100 comprises a controller 102 which controls the execution of refrigerator 10. In the exemplary embodiment, controller 102 is implemented with at least one of a microprocessor, a digital signal processor (DSP), etc. Operatively coupled to controller 102 are control interface 32, a stepper motor (not labeled), solenoid element 66, and evaporator fan 76. A temperature sensor 104 is also operatively coupled to controller 102 for detecting temperature in fresh food compartment 12.

Figure 4:
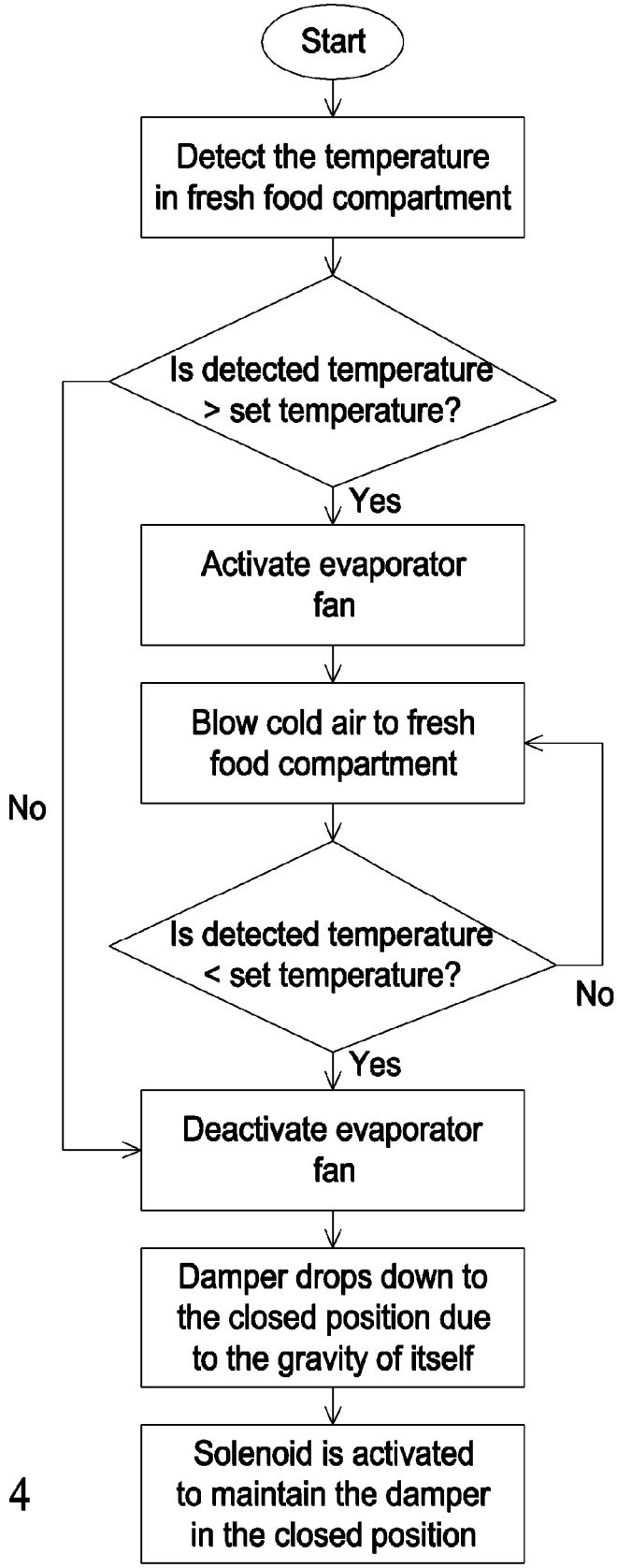
FIG. 4 is a block diagram of the operation of damper assembly executable by the controller shown in FIG. 3.

FIG. 4 is a block diagram depicting the operation of damper assembly 60 (shown in FIG. 2) executable by controller 102 (shown in FIG. 3). In operation, temperature sensor 104 detects the temperature in fresh food compartment 12 during the operation of refrigerator 10. If temperature sensor 104 detects that the temperature in fresh food compartment 12 is higher than a set temperature, temperature sensor 104 provides feedback to controller 102 which will then activate evaporator fan 76 to move cold air to fresh food compartment 12 from freezer compartment 14. As such, cold airflow is forced from second opening 72 of housing 62, through duct 74 to housing 62. Under the action of the airflow pressure, damper 64 is rotated about hinge 78 from a closed position to an open position (in phantom).

With the continual entry of cold airflow, the temperature in fresh food compartment 12 is lowered. Once temperature sensor 104 detects that the temperature in fresh food compartment 12 is lower than the set temperature, evaporator fan 76 is deactivated by controller 102 which receives the feedback from temperature sensor 104. Without the airflow passing through damper 64, damper 64 moves from the open position to the closed position due to the weight of damper 64. Alternatively, or in addition thereto, solenoid 66 is actuated upon temperature sensor 104 detecting the temperature is below a threshold level. Activation of solenoid 66 actuates plunger 82 and moves damper 64 from the open position to the closed position, regardless of air flow attempting to pass through damper 64. Then, once the air cease to flow out of fan 76, solenoid 66 can be de-activated and damper 64 will remain closed due to its own weight, until evaporator fan 76 starts and air flows against damper 64.

While the invention has been described in terms of various specific embodiments, those skilled in the art will recognize that the invention can be practiced with modification within the spirit and scope of the claims.

We claim:

1. A damper apparatus, comprising:

a housing configured to allow air to flow therethrough;

a damper configured to be in an open position under the pressure of air which flows through said housing and in a closed position due to a weight of said damper when no air is flowing through said housing; and a solenoid element actuatable to move said damper from the open position to the closed position and maintain said damper in the closed position regardless of airflow.

2. A damper apparatus in accordance with claim 1 wherein said solenoid element is a direct-current solenoid with a stepper motor.

3. A damper apparatus in accordance with claim 1 wherein said damper is mounted to said housing with a hinge.

4. A damper apparatus in accordance with claim 1 wherein said damper is operatively coupled to said solenoid element.

5. A damper apparatus in accordance with claim 1 further comprising a plunger connecting said solenoid element with said damper.

6. A damper apparatus in accordance with claim 5 wherein said damper comprises a counterweight element mounted on the top end thereof to facilitate eliminating swing of said damper.

7. A damper apparatus in accordance with claim 1 wherein said housing is made from polystyrene foam.

8. A refrigerator, comprising:

a housing defining a fresh food compartment and a freezer compartment;

a fan configured to provide airflow through the fresh food compartment and the freezer compartment; and a damper assembly comprising:

an airflow passage configured to allow air to flow from the freezer compartment to the fresh food compartment;

a damper configured to be in an open position under the pressure of the air flowing through said airflow passage and in a closed position due to a weight of said damper when air is flowing through the fresh food compartment; and a solenoid element actuatable to move said damper from the open position to the closed position and maintain said damper in the closed position regardless of airflow.

9. A refrigerator in accordance with claim 8 wherein said solenoid element is a direct-current solenoid with a stepper motor.

10. A refrigerator in accordance with claim 8 wherein said damper is mounted to said housing with a hinge.

11. A refrigerator in accordance with claim 8 wherein said damper is operatively coupled to said solenoid element.

12. A refrigerator in accordance with claim 8 further comprising a plunger connecting said solenoid element with said damper.

13. A refrigerator in accordance with claim 12 wherein said damper comprises a counterweight element mounted on the top end thereof to facilitate eliminating swing of said damper.

14. A refrigerator in accordance with claim 8 comprising at least one duct in flow communication with said airflow passage.

15. A refrigerator in accordance with claim 8 comprising a controller, a sensor, and a solenoid element, wherein said sensor and said solenoid element are operatively coupled to said controller.

16. A method of assembling a refrigerator, said method comprising:

providing a housing with a fresh food compartment and a freezer compartment;

providing an airflow passage configured to allow air to flow between the freezer compartment and the fresh food compartment;

coupling a damper to the airflow passage, wherein the damper is configured to be in an open position under the pressure of air which flows through the airflow passage and in a closed position due to a weight of the damper when airflow is not flowing in the housing; and operatively coupling a solenoid to the damper, wherein the solenoid is configured to move the damper from the open position to the closed position and maintain the damper in the closed position when the solenoid is actuated, regardless of airflow.

17. A method of assembling a refrigerator in accordance with claim 16 wherein coupling a damper to the airflow passage comprises hinging the damper at a position adjacent the airflow passage.

18. A method of assembling a refrigerator in accordance with claim 16 wherein coupling a damper to the airflow passage comprises hinging the damper at a position above the airflow passage.

19. A method of assembling a refrigerator in accordance with claim 16 wherein coupling a solenoid to the damper comprises coupling a stepper motor with the solenoid.

20. A method of assembling a refrigerator in accordance with claim 16 wherein coupling a solenoid to the damper further comprises utilizing a plunger to connect the solenoid with the damper.

21. A method of assembling a refrigerator in accordance with claim 20 further comprising mounting a counterweight element on one end of the damper where the plunger connects with the solenoid.

22. A cooling circuit for a refrigeration device having at least a first compartment and a second compartment, said cooling circuit comprising:

a cooling unit configured to cool the fresh food compartment and the freezer compartment; and a damper assembly positioned within the first compartment to provide airflow communication with the fresh food compartment and the freezer compartment, said damper assembly comprising:

a damper configured to be in an open position under the pressure of the air flowing from the second compartment to the first compartment and in a closed position due to a weight of said damper when no air is flowing through the first compartment; and a solenoid apparatus actuatable to move said damper from the open position to the closed position and maintain said damper in the closed position regardless of airflow.

23. A cooling circuit in accordance with claim 22 wherein said solenoid is a direct-current solenoid.

24. A cooling circuit in accordance with claim 22 wherein said damper is operatively coupled to said solenoid element.

25. A cooling circuit in accordance with claim 22 further comprising a plunger connecting said solenoid element with said damper.

26. A cooling circuit in accordance with claim 25 wherein said damper comprises a counterweight element mounted on the top end thereof to facilitate eliminating swing of said damper.

* * * * *